United States Patent [19]

Sharp

[11] Patent Number: 4,846,313

[45] Date of Patent: Jul. 11, 1989

[54] FALL-ARREST APPARATUS

[75] Inventor: George P. Sharp, Clwyd, United Kingdom

[73] Assignee: Barrow Hepburn Equipment Ltd., London, England

[21] Appl. No.: 55,067

[22] Filed: May 28, 1987

[30] Foreign Application Priority Data

May 28, 1986 [GB] United Kingdom ..... 8612945
Dec. 23, 1986 [GB] United Kingdom ..... 8630788

[51] Int. Cl.[4] ..... B66D 1/48; B66D 1/14

[52] U.S. Cl. ..... 188/187; 188/72.8; 188/71.2; 242/99; 254/267

[58] Field of Search ..... 188/187, 71.2, 72.8, 188/72.7; 242/99; 254/267, 362; 116/67 A, 68

[56] References Cited

U.S. PATENT DOCUMENTS 297,126 4/1884 Freeman ..... 188/728
4,489,919 12/1984 Ostrobrod ..... 254/267

FOREIGN PATENT DOCUMENTS 2165763 8/1973 France ..... 254/267
1552667 9/1979 United Kingdom ..... 188/72.8

*Primary Examiner*—Andres Kashnikow
*Assistant Examiner*—Mark Le
*Attorney, Agent, or Firm*—Dennison, Meserole, Pollack & Scheiner

[57] ABSTRACT

A fall-arrest apparatus comprises a cable drum (2) and a friction brake including a rotatable brake disc (14) which is pressed against a stationary brake ring (15). In the event that the drum accelerates in the unwinding direction to a certain speed, pawls (19,20) carried by the drum (2) are centrifuged into driving engagement with the brake disc (14) to cause braking of the drum. The apparatus incorporates a fail-safe brake member (24) which is in screw-threaded engagement with a fixed part and is mechanically coupled to the rotatable brake disc (14) so that rotation of the brake disc (14) causes the fail-safe brake member to be screwed towards an operative position in which it causes progressive braking force to be applied between co-operating braking members (24,27,29).

10 Claims, 5 Drawing Sheets

FALL-ARREST APPARATUS

This invention relates to apparatus comprising a rotatably mounted drum or spool on which a rope, cable or other coilable tie member can be wound, and a braking mechanism which automatically stops or retards rotation of the drum or spool if its rotational speed or acceleration rises above a certain value.

Apparatus of this kind can be used, for example, for safety lowering or fall-arrest purposes by attaching the drum or spool holder or casing to a fixture and attaching the free end of a safety line, wound onto the drum or spool, to a person or object to be protected. A particularly important use of such apparatus is for the protection of a person working at high levels above the ground, using a safety line which is attached to a personal safety belt or harness. Apparatus for such purpose customarily incorporates a drum which is self-winding by spring action so that slack in the safety line is automatically taken up and cannot accumulate and thereby create a further safety hazard.

The automatic braking of the drum or spool if its unwinding speed exceeds a certain value can be achieved by means of a friction brake operated by a centrifugal clutch. Engagement of the clutch serves to couple the rotating drum or spool to a brake component which is thereby caused to rotate against the frictional resistance imposed by (a) contacting fixed brake component(s). A braking mechanism of this form can be incorporated without undue expense and in apparatus of modest size. Various designs of apparatus having such a friction brake mechanism are known, see e.g. United Kingdom Pat. Nos. 1 463 589 and 1 552 667.

Although such automatic braking mechanisms are generally effective and reliable, failures do occasionally occur and it is desirable to provide some form of fail-safe arrest mechanism.

French Pat. No. 2 165 763 describes a safety-line drum having two centrifugally actuated friction brakes arranged on opposite sides of the drum. These brakes operate simultaneously but independently. If one brake fails due to breakage or malfunction of its centrifugal clutch the other brake can serve on its own to arrest the drum.

United Kingdom Pat. No. 1 463 589 describes a drum wherein a centrifugally actuated friction brake is backed up by a centrifugally actuated arrestor which abruptly arrests rotation of the drum in the event of continued rapid rotation of the drum consequent upon failure of the friction brake.

The fail-safe brakes in these known appliances do not provide adequate security against the risk of brake slippage such for example as may be caused by deterioration or wear of friction brake surfaces, intrusion of foreign material or temperature or other environmental conditions. With a braking system as described in the French patent even the engagment of the centrifugal clutches of both friction brakes would not ensure safe arrest of a falling body in the event of brake slippage. In the case of the system described in the British patent, the operation of the fail-safe brake is dependent on the acceleration of the drum to a certain speed following engagement of the clutch for actuating the friction brake. If this friction brake were to slip but insufficiently for the drum to reach the critical speed, the fail-safe brake would not function.

It is an object of the invention to provide a braking system which provides greater security against the risks of friction brake slippage.

Apparatus according to the present invention is broadly defined in claim 1 hereof. The apparatus, like certain previously known apparatus above referred to, comprises a rotatably mounted drum on which a rope, cable or other coilable tie member can be wound, a primary brake comprising a component which is rotatable against a frictional resistance, a centrifugal clutch for automatically coupling such component to the drum to cause braking of the drum if it accelerates to a certain speed in the unwinding direction, and a back-up or fail-safe brake (hereafter called "fail-safe brake") for arresting the drum in the event of malfunction of said primary brake. The apparatus according to the invention is characterised in that said fail-safe brake comprises a screw-threaded member which is mounted for advancement by screw action from a retracted position towards an operative position in which its rotation applies progressive braking pressure between co-operating braking surfaces, and there is an operative connection between such member and said rotatable primary brake component such that rotation of that component causes screwing of said threaded fail-safe brake member towards said operative position.

The threaded fail-safe brake member of apparatus according to the invention is rotated and advanced towards its operative position whenever the rotatable primary brake component becomes rotated, i.e. whenever that component is coupled to the drum by the centrifugal clutch. Consequently the fail-safe brake inevitably becomes applied if the unwinding rotation of the drum continues through a certain angular distance following the clutch engagement, no matter what be the speed of that rotation. The fail-safe brake therefore affords security not only in the event of complete failure of the primary brake but also in a case of continued unwinding of the drum, against the primary braking resistance, due to impaired primary brake efficiency.

The angular distance through which the drum can unwind, following engagement of the primary brake clutch, before the fail-safe brake becomes applied, depends on the distance between the retracted and operative positions of the threaded fail-safe brake member and the pitch of its thread. For any given apparatus, these factors should be selected having regard to its intended use. They should normally be such that in the event of the heaviest envisaged load on the cable caused by a fall, the fail-safe brake will not become applied provided that the primary brake functions properly.

The invention is primarily intended for application in personnel fall-arrest apparatus. With a view to that field of use, in preferred embodiments of the present invention, the performance of the primary brake is such that the apparatus satisfies the dynamic performance standard prescribed in paragraph 7.5.2 of British Standard Specification (BSS) 5062 :Part 1: 1985.

If a body weighing 220 lbs(100 Kg) falls freely from a position alongside the fall-arrest apparatus, with about 200 mm of slack cable between that apparatus and the body, the apparatus can be regarded as fully satisfying the said BSS performance standard if the body is arrested within a distance of 1.5 meters from the point at which the cable becomes taut and the maximum shock-load on the body is in the range 5–8 KN. In particularly preferred embodiments the fall-arrest capability of the primary brake is such that it also satisfies DIN Standard 23 326 of 1982.

Preferably the threaded fail-safe brake member can be pre-set in a retracted position such that the apparatus is capable of arresting at least two successive dynamic performance tests according to the said BSS 5062: Part 1:1985 and most preferably at least three dynamic performance tests according to DIN 23 326 without the threaded fail-safe brake member reaching its operative position. The ability of the apparatus to be safely used for arresting at least two and preferably at least three successive falls, without the need for the threaded fail-safe brake member to be re-set, makes the apparatus useful in circumstances where neither servicing facilities or replacement apparatus are readily available.

The threaded fail-safe brake member is preferably mounted for axial advance movement in a direction parallel with the axis of the drum. This arrangement facilitates mechanical coupling of this member to the rotatable primary brake component. It has been found particularly beneficial from standpoints of design and efficiency for the said threaded member to advance in a direction towards the drum. This necessitates the screw-threading of this member to be of opposite hand to the unwinding direction of rotation of the drum. According to another preferred and advantageous feature the fail-safe braking pressure exerted by the said threaded member is exerted against the aforesaid rotatable brake component.

If the threaded fail-safe brake member advances in a direction towards the drum as above referred to the said member and the drum can be provided with co-operating parts of a ratchet-type locking device which becomes effective after a predetermined advance motion of said threaded member to allow the drum to be rotated, as for example by a winch, to raise the fallen body, while preventing rotation of the drum in the reverse, i.e. unwinding, direction. Such a locking device prevents the apparatus from being re-used until the threaded fail-safe brake member has been re-set.

It is of importance to provide a robust coupling between the said threaded fail-safe brake member and the said rotatable primary brake component. Preferably they are splined together. A spline connection provides a strong positive connection for transmitting torque while leaving the threaded fail-safe brake member free for its axial advance movements relative to the primary brake component.

The threaded fail-safe brake component is in screw engagement with a fixed part of the apparatus. It is convenient for the said component to be in screw engagement with an internally threaded socket in the inside of a casing of the apparatus.

The fail-safe brake preferably incorporates a deformable energy-absorber, e.g. one or more deformable discs or washers, which become(s) progressively deformed as the threaded member advances in its operative position.

The primary brake can be of a kind comprising friction braking components which are pressed together under a progressively increasing force when the primary brake is applied. However care must be taken when designing a brake of this form to ensure a reliable braking action without imposing a high shock load on a person or object attached to the safely line. It is therefore preferred for the primary brake to comprise co-operating friction braking components which are permanently held pressed together, at least one of such components being fixed and the other or at least one other of them being rotatable relative to such fixed component(s) by force which is transmitted from the drum via the centrifugal clutch. A brake of this form does not require to be re-set following any use of it. The contact pressure between the co-operating relatively displaceable friction braking components can be adjustable by means of adjustment screws.

Reference is now made to certain embodiments of the invention, selected by way of example, illustrated in the accompanying drawings, in which.

Figure 1:
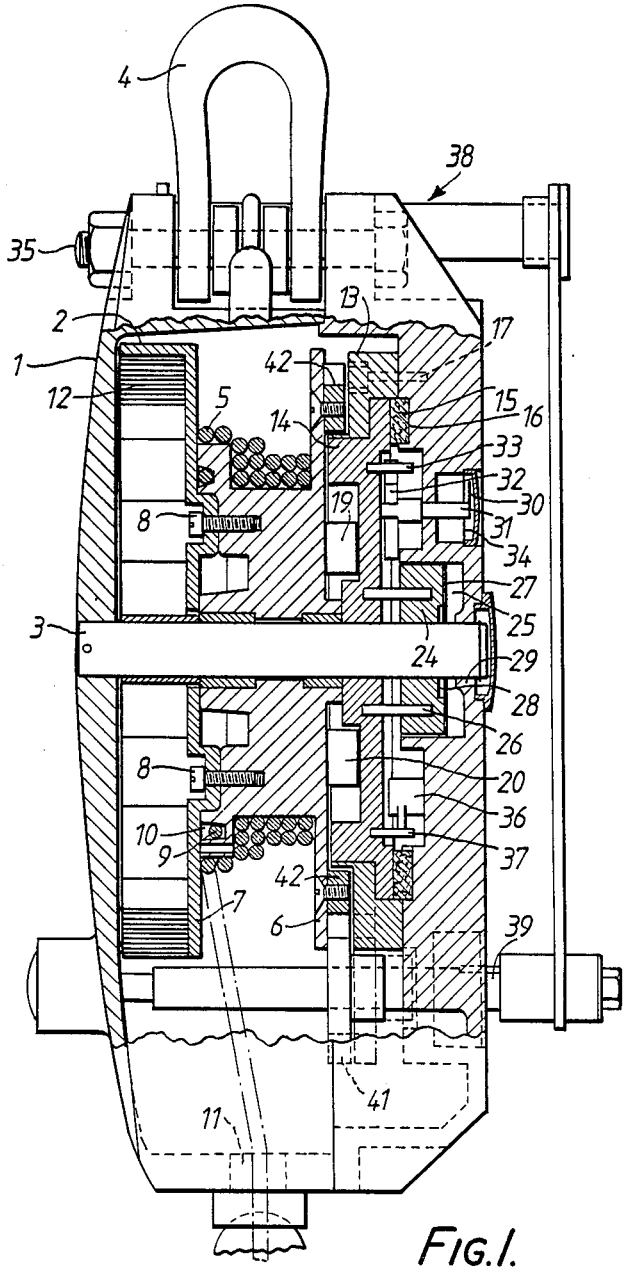
FIG. 1 is a side elevation of a safety block according to the invention, partly sectioned on line II—II in FIG. 2.
Figure 2:
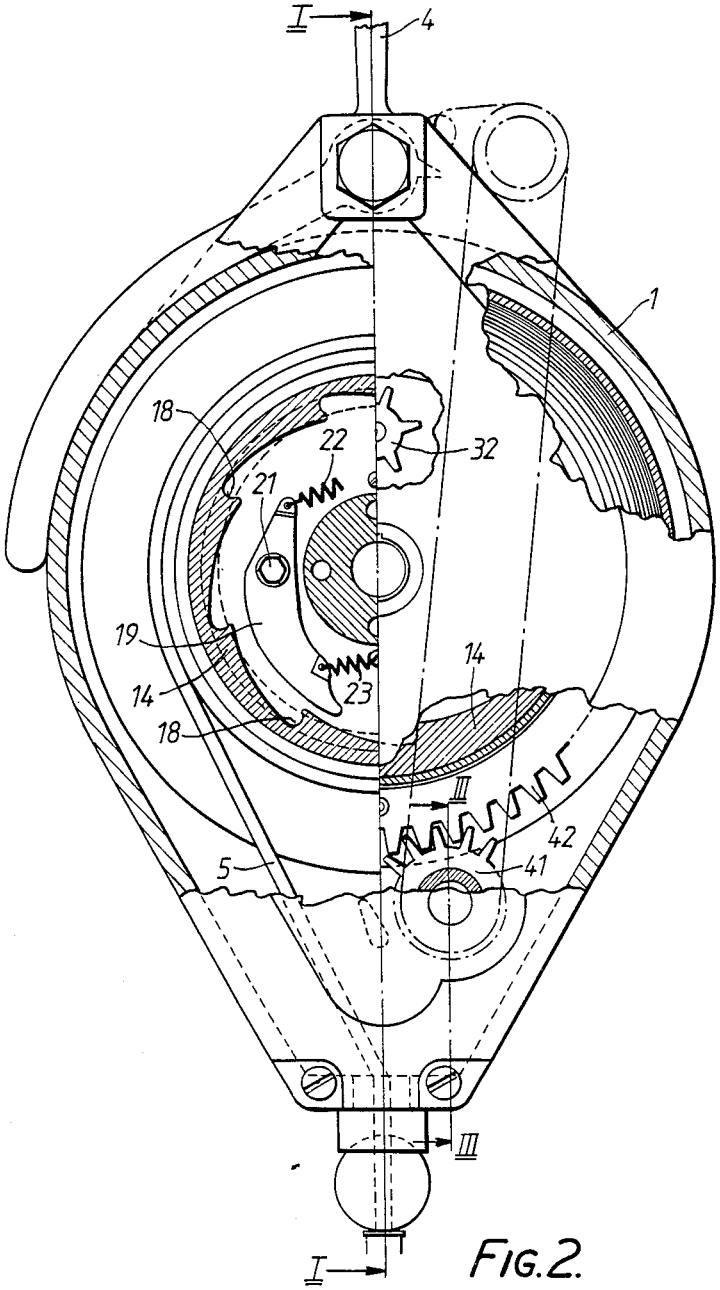
FIG. 2 is a partly sectioned front view of that block.
Figure 3:
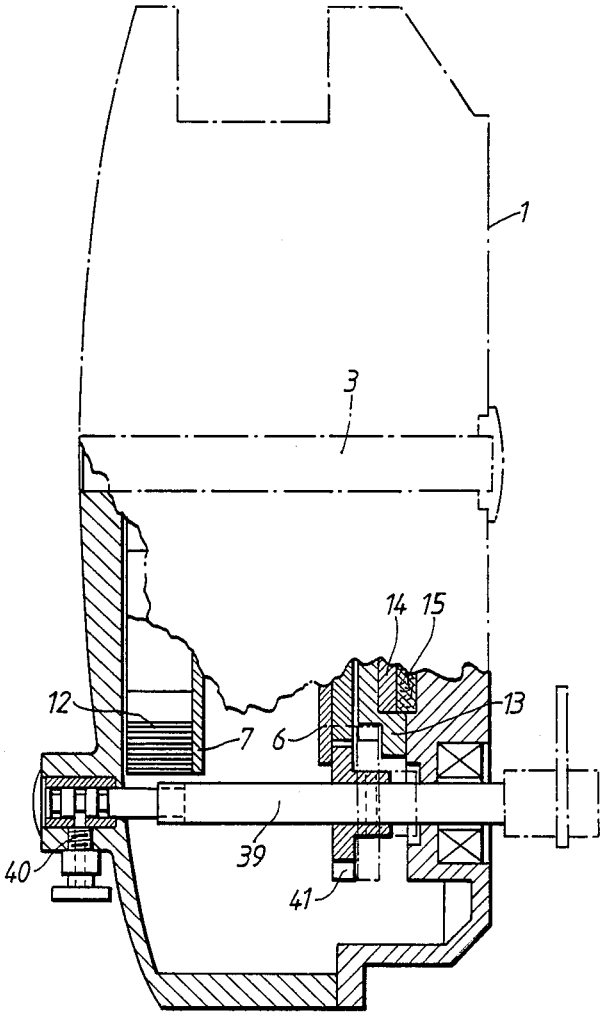
FIG. 3 is a side elevation of the same block, partly sectioned on line III—III in FIG. 2.

The safety block represented in FIGS. 1 to 3 comprises an aluminium alloy casing 1 within which a cable drum 2 is mounted for free rotation about a shaft 3 the ends of which are supported by the casing. At the top of the casing there is a shackle 4 by which the block can be suspended from a fixture.

A cable 5 is wound onto the drum 2. The drum is formed in two parts 6,7 which are secured together by bolts 8 after insertion of an end portion 9 of the cable in an arcuate groove 10 in the drum part 6. The groove is of tapered section and reduces in depth towards one end. By the tightening of bolts 8 the cable end portion becomes jammed tightly into the groove. The cable leads out of the casing 1, from the drum, via a bottom aperture 11 so that its free end can be attached to a person or object to be protected.

By pulling on the cable 5, the drum can be rotated in the unwinding direction, against the action of a spiral spring 12 housed within the drum part 7. So long as the unwinding speed remains below a certain level, the block offers virtually no resistance to the unwinding of the cable other than that imposed by the spring. However if the unwinding speed increases to that level, due for example to a person attached to the cable 5 falling, the drum becomes arrested by a friction brake (primary brake) through the agency of a centrifugal clutch mechanism as will now be described.

The primary brake is formed by a sandwich of four parts, namely a stainless steel pressure ring 13, a brass disc 14, an asbestos ring 15 and a part 16 of the block casing 1. That part of the casing is provided wth a machined annular groove in which the asbestos ring 15 is seated. The said four brake parts are permanently clamped together by a series of bolts such as 17 which are angularly spaced around the assembly. The bolts connect the pressure ring 13 to the casing 1 and clamp the disc 14 and the asbestos ring 15 between those parts. Behind the heads of the bolts 17 there are spring washers (not shown). The bolts 17 are torqued to exert a clamping pressure such that if the brake comes into operation due to high acceleration of a body attached to the cable the body will be decelerated to zero within a short time without however being subjected to a harmful shock load. In the specific apparatus illustrated, which is intended as a fall arrest device for use by personnel, the bolts 17 are torqued to exert a clamping pressure of 0.6 Newton meters. The block complies with the British Standard dynamic performance standard prescribed in BSS 5062: Part 1: 1985. The block also meets the safety standard prescribed by DIN Standard 23 326.

In the event of high acceleration of the drum 1 due to a fall, the drum 1 becomes automatically coupled to the primary brake by a centrifugal clutch mechanism, which is constructed and operates as follows. The disc 14 has an inner series of ratchet teeth 18 (FIG. 2). Two pawls 19,20 for engaging these teeth are pivotally connected to the drum part 6 by studs, one of which, designated 21, appears in FIG. 2. The pawls are disposed to opposite sides of a diametral plane containing the drum axis and are interconnected by helical springs 22,23 which bias the pawls radially inwardly about their pivots. If the drum accelerates in the unwinding direction due to the fall of a workman attached to the cable, the pawls pivot under the centrifugal force, against the action of springs 22,23, and thereby the ends of the pawls are caused to engage behind ratchet teeth 18 of the disc 14 and this ring is forced to rotate against the resistance imposed by the primary brake of which the disc 14 is a part. This resistance is such that the pay-out speed of the cable is decelerated to zero at a safe rate.

The apparatus incorporates a fail-safe brake which becomes applied if a falling body is not arrested within a certain fall distance following application of the primary brake. This fail-safe brake comprises a phosphor bronze ring 24 which is in screw engagement with a socket 25 defined by a hub portion of the casing 1. The ring 24 is coupled to the disc 14 of the primary brake by pins 26. These pins are secured to the disc 14 and intrude into blind bores in the phosphor bronze ring 24. The pins can therefore transmit a turning moment to ring 24 while allowing it to advance axially away from the disc 14 as necessitated by the threaded engagement between the ring 24 and the casing 1. Between the ring 24 and the bottom of the socket 25 there is a spring steel brake disc 27 which is carried along the shaft 3 by the ring 24 when it becomes screwed along the socket 25. In the illustrated pre-set retracted position of the ring 24, its spacing from the bottom of the socket 25 is such, (taking into account the pitch of the ring and socket threads) that in the event of the primary brake disc 14 being caused to turn, i.e. in the event of application of the primary brake, as a result of the fall of a person attached to the cable, the primary brake will in the normal way arrest the fall before spring steel brake disc 27 comes into contact with the casing 1 at the bottom of the socket 25. In the event that the primary brake fails to arrest the fall within a predetermined maximum free-fall distance, the disc 27 becomes forced against said casing and a fail-safe braking force is thereby exerted. The ring 24 has an annular rebate groove 28 behind the inner margin of the brake disc 27. At the bottom of the socket 25 the casing 1 is shaped to provide a boss 29 opposite that groove. The initial contact of the disc 27 with the casing is between the inner margin of the disc and the said boss 29. Thereafter, as the ring 24 continues to be screwed into the socket, the disc 27 becomes deformed, its inner margin being deflected into the rebate groove 28. Following the initial contact there is accordingly a progressive build up of the braking force exerted by the fail-safe brake.

The number of times which the fail-safe brake ring 24 has to be rotated in order to move it from its illustrated pre-set retracted position into an operative position in which it forces brake disc 27 against the boss 29 is more than twice the maximum number of times the disc 14 is liable to be rotated if the apparatus is subjected to British Standard fall-arrest test BSS 5062: Part 1: 1985. The block can therefore be allowed to arrest two such test falls in succession before it is necessary to re-set the ring 24 to its fully retracted position.

The block incorporates an indicating device which gives a readable indication of the necessity or otherwise for the fail-safe brake ring 24 to be re-set. The indicating device comprises a pointer 30 which is mounted on a spindle 31. The spindle is rotatably supported in the block casing 1 and carries, at its end within the casing, a sprocket 32. A pin 33 secured to the brake disc 14 is positioned so that it indexes this sprocket once during each revolution of that disc. Behind the pointer 30 is a dial 34 bearing markings which show the significance of the pointer position in terms of the position of the fail-safe brake ring 24. Inspection of the indicator accordingly suffices to determine whether re-setting of that ring is necessary. In order to re-set the fail-safe brake ring, the block casing has to be opened by removing casing bolts such as 35 and removing what in the aspect of FIG. 1 is the right-hand casing section, together with the brake assemblies, from the shaft 3. The primary brake bolts 17 can then be loosened and the primary brake disc 14 rotated to retract the fail-safe brake ring.

The illustrated embodiment also incorporates an audio-alarm device 36 which automatically sounds in the event of the primary brake being brought into use. The alarm device incorporates a micro-switch which is mounted to the block casing. A pin 37 is secured to the brake disc 14 and trips the micro-switch when or before the disc 14 has rotated through 360°.

The block also incorporates mechanism enabling a weight suspended by the cable can be winched up towards the block. This mechanism comprises a winching handle 38 which is shown in FIGS. 1 and 2 in a stowage position with its hand grip portion lying across the top portion of the block. The handle can be removed from its shaft 39 and reconnected thereto in a reversed, operative, position. A locking pin 40 (FIG. 3) intrudes into a circumferential groove on the shaft. This pin can be retracted to allow the handle with its shaft to be displaced axially (to the left in the aspect of FIGS. 1 and 3). This displacement brings a sprocket 41 on the shaft 39 into intermeshing engagement with a series of teeth on the inside of an annular ring 42 which is bolted to the drum 2. The drum can accordingly then be turned by means of the handle to raise the suspended weight.

Figure 4:
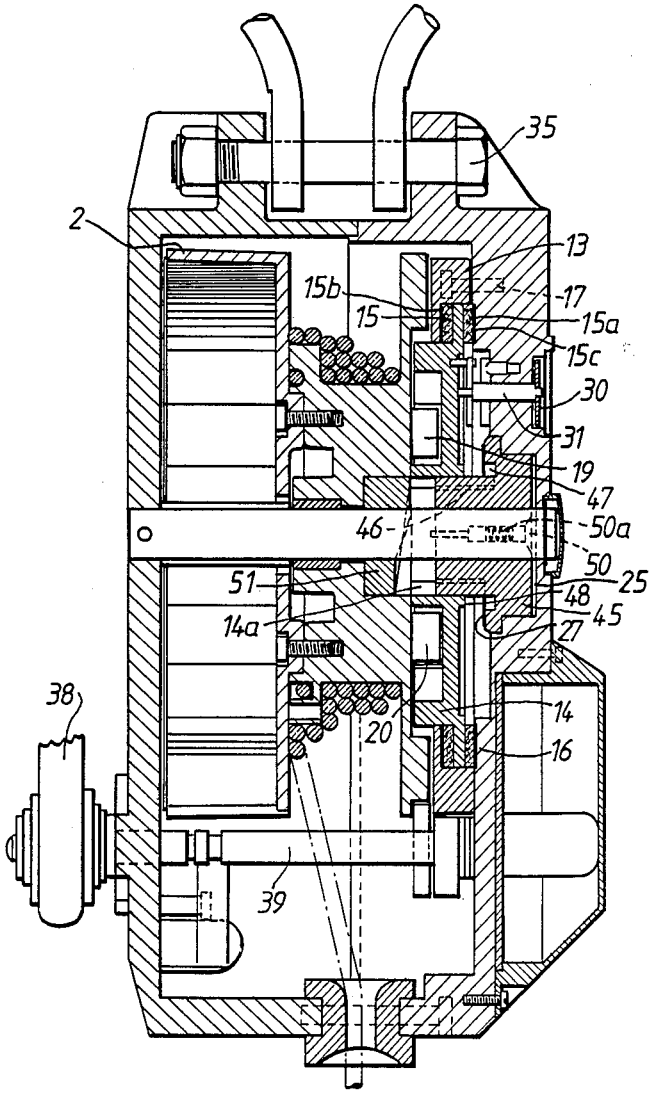
FIG. 4 is a cross-sectional elevation of another safety block according to the invention.

Reference is now made to the apparatus shown in FIG. 4. This apparatus is very similar to that illustrated in FIGS. 1 to 3 and only certain parts of the FIG. 4 apparatus need be described. Parts corresponding with parts of the apparatus illustrated by FIGS. 1 to 3 are indicated with the same reference numerals.

The primary brake comprises a pressure ring 13, a disc 14, asbestos rings **15,15*a*, a part 16 of the block casing 1, and stainless steel washers 15*b* and 15*c* which are respectively interposed between the asbestos ring 15 and the pressure ring 13 and between the asbestos ring 15*a* and the casing part 16. The said brake parts are permanently clamped together by a series of bolts such as 17 which are angularly spaced around the assembly. The bolts connect the pressure ring 13 to the casing 1** and exert clamping pressure on the interposed parts.

Pawls 19,20 are pivotally connected to the drum. If the drum accelerates in the unwinding direction due to the fall of a workman attached to the cable, the pawls pivot under the centrifugal force, against the action of springs, and free ends of the pawls are thereby caused to engage behind ratchet teeth of the disc 14 and this disc is consequently forced to rotate against the resistance imposed by the primary brake of which the disc 14 is a part. This resistance is such that the pay-out speed of the cable is decelerated to zero at a safe rate.

The fail-safe brake which comes into play in the event that the primary brake fails to arrest the fall within a predetermined maximum fall distance comprises a ring 45 which is in screw engagement with a socket 25 defined by a hub portion of the casing 1. The hand of the threads forming the screw connection is opposite to the hand of rotation of the drum 2 during pay-out of the cable 5. The ring 45 is keyed to the disc 14 of the primary brake. The key coupling comprises two diametrically opposed, axially directed ribs 46 on the ring 45 which engage keyways 14*a* in the disc 14. The disc 14 can therefore transmit a turning moment to ring 45 while allowing it to advance axially towards the drum 2 as necessitated by the threaded engagement between the ring 45 and the casing 1. A spring steel brake disc 27 is fitted onto the ring 45. The inner margin of this disc overlies a rebate groove 47 in the ring 45. The primary brake disc 14 is shaped to provide an annular rib 48 which is located opposite to and is of slightly smaller width than the said rebate groove. In the event that the primary brake fails to arrest the fall within a predetermined maximum fall distance, the disc 27 abuts against the rib 48 and becomes deformed as the ring 45 continues to be screwed towards the drum. There is accordingly a progressive build up of the braking force exerted by the fail-safe brake.

The torque resistance of the primary brake of the particular illustrated embodiment is such that the block meets the requirements of BSS 5062:Part 1: 1985. The falling body is arrested within a free-fall distance of approximately 325 mm. The number of times which the fail-safe brake ring 45 has to be rotated in order to move it from its illustrated pre-set retracted position into the position in which the fail-safe braking action takes place, is more than five times the number of times that ring is rotated during such a fall-arrest test. In consequence, assuming that the primary brake functions properly, the block can be allowed to arrest several such falls in succession before it is necessary to open the casing and re-set the ring 24 to its fully retracted position.

The indicating device comprising a pointer 30 for indicating the position of the fail-safe brake ring 45 is similar to that of the apparatus shown in FIGS. 1–3. The dial behind the pointer bears markings which show the balance of the operational life of the apparatus before it has to be serviced by restoring the ring 45 to its fully retracted position. The dial has differently coloured sectors: a green sector, followed by an amber section, followed by a red section. After two or three falls arrested by the primary brake the pointer 30 will have moved from the green to the amber sector of the dial. After the arrest of two further falls by the primary brake, the pointer will have moved onto the red sector which is an indication that the apparatus must not be used again until it has been serviced. In order to re-set the fail-safe brake ring 45 the block casing has to be opened by removing casing bolts such as 35 and removing what in the aspect of the drawing is the right-hand casing section, together with the brake assemblies, from the shaft 3. The primary brake bolts 17 can then be loosened and the ring 14 rotated to cause the fail-safe brake ring 45 to be screwed back into its fully retracted position.

The block also incorporates a locking mechanism which locks the drum against rotation in the unwinding (cable pay-out) direction as soon as the fail-safe brake has been caused to function. This locking means is of a ratchet type. A pin 50 is mounted in a passageway extending through the fail-safe brake ring 45. This passageway is in spaced parallel relationship to the central bore of the ring, through which the drum shaft 3 extends. The pin is biased by a compression spring 50*a* into its illustrated advanced position in which the tips of the pin slightly projects from the inner end of the ring 45. In the hub portion of the drum 2, facing the fail-safe brake ring 45 there is a socket in which a machined insert 51 is secured. The exposed face of this insert is shaped to provide an inclined ramp whose course extends around the ring axis, the opposed ends of the ramp being bridged by a step. In the event that the fail-safe brake is brought into action, causing deformation of the steel brake disc 27, the projecting tip of the pin 50 comes into contact with the said ramp. The hand of inclination of the ramp is such that the drum can be turned by a winch in the re-wind direction so as to rewind the cable onto the drum but abutment of the pin against the step face prevents the drum from turning in the unwind direction. This locking device therefore ensures that the block cannot again be put to use until it has been serviced.

Apparatus according to the invention can incorporate more than one primary friction brake. For exammple two primary friction brakes each comprising a component which is rotatable against a frictional resistance may be provided and these brakes can be actuatable via a common centrifugal clutch or via independent centrifugal clutches. If there is more than one primary friction brake they may be actuated by independent centrifugal clutches which are arranged so that they engage simultaneously or in succession during acceleration of the drum in the unwinding direction.

Independent clutches may be provided for actuating one and the same primary friction brake. In this case the clutches can be designed to engage at different rates of rotation of the drum. One clutch will then serve as a safety or back-up clutch which comes into operation in the event of unwinding acceleration of the drum beyond the speed at which the other clutch should have engaged.

Figure 5:
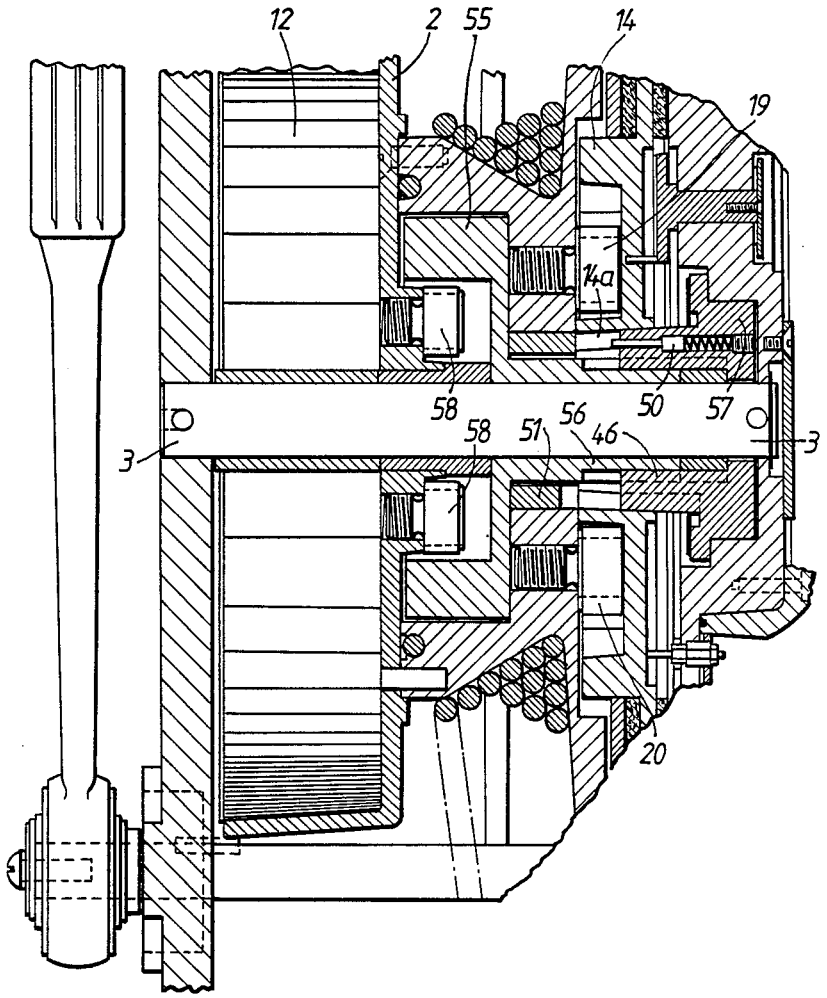
FIG. 5 is a fragmentary view in cross-section of a third safety block according to the invention.

FIG. 5 illustrates part of a safety apparatus according to the invention which incorporates independent clutches functioning in this manner. The construction of the apparatus is substantially the same as that of the apparatus according to FIG. 4 except in the following respect: The body of the drum 2 houses a co-axial insert 55 which has an integral spigot portion 56 which intrudes into the bore of the threaded fail-safe brake member 57. The body of the drum is rotatable relative to that insert and during normal rotations of the drum the insert remains stationary on the shaft 3. The spigot portion 56 has a spline connection with the threaded fail-safe brake member 57. The opposed larger end portion of the insert is recessed and is internally formed with peripheral ratchet teeth for engagement by pawls 58 which are pivotally mounted on the part of the drum which houses the return spring 12. The pawls are restrained against outward pivotal motion by springs (not shown) the strength of which is such that such pivotal motion occurs under centrifugal force at a drum speed somewhat higher than that at which the pawls 19/20 should engage the rotatable brake disc 14 and cause braking of the drum. Should the pawls 58 engage the teeth of the insert 55 the splined connection of this insert with the fail-safe brake member 57 causes the latter to rotate towards its operative position.

What is claimed is:

1. Apparatus comprising a rotatably mounted drum (2) on which a rope, cable or other coilable tie member (5) can be wound; a primary brake comprising a component (14) which is rotatable against a frictional resistance, a centrifugal clutch (18,19,20) for automatically coupling such component (14) to the drum (2) to cause braking of the drum if it accelerates to a certain speed in the unwinding direction; and a fail-safe brake (24,27,29; 45,27,48; 57,27,48), said fail-safe brake comprising a screw-threaded member (24,45,57) which is mounted for advancement by screw action from a retracted position towards an operative position and co-operating brake means (27,29) against which said screw-threaded member exerts progressive braking pressure by its screw action on reaching that operative position, and means (26;46,14*a*;) forming an operative connection between such screw-threaded member (24,45,57) and said rotatable primary brake component (14) such that rotation of that component (14), no matter what the speed of that rotation, causes screwing of said screw-threaded member (24,45,57) towards said operative position, said retracted position of said screw-threaded member being such that such member reaches said operative position only in the event of malfunction of said primary brake.

2. Apparatus according to claim 1, wherein the drum and said primary and fail-safe brakes are enclosed in a casing and said screw-threaded member (24,45,57) is in screw engagement with a female-threaded bore in said casing.

3. Apparatus according to claim 1 or 2, wherein the screw-threaded member (24,45,57) is mounted for retraction and advance movements in a direction parallel with the axis of the drum (2) and the thread on said screw-threaded member (24,45,57) is of opposite hand to the unwinding direction of rotation of the drum (2) whereby in moving from a retracted toward said operative position, said screw-threaded member moves toward said drum.

4. Apparatus according to claim 1 or 2, wherein the thread on said screw-threaded member (24,45,57) is of opposite hand to the unwinding direction of rotation of the drum (2) whereby advance movements of such screw-threaded member are caused to take place in a direction towards said drum, and said screw-threaded member and said drum are provided with co-operating parts (50,51) of a ratchet type locking device, which device becomes effective after a predetermined advance motion of said screw-threaded member to allow the drum to be rotated in the winding direction for raising a fallen body, while preventing rotation of the drum in the unwinding direction.

5. Apparatus comprising a rotatably mounted drum (2) on which a rope, cable or other coilable tie member (5) can be wound, primary braking means comprising a component (14) which is rotatable against a frictional resistance and a centrifugal clutch (18,19,20) for automatically coupling such component (14) to the drum (2) to cause braking of the drum if it accelerates to a certain speed in the unwinding direction, said primary braking means having a proper braking performance such that the apparatus satisfies the dynamic performance standard of British Standard Specification 5062 Part 1: 1985; and a fail-safe brake (24,27,29; 45,27,48; 57,27,48) comprising a screw-threaded brake member (24,45,57) which is in screw-threaded engagement with a fixed part of the apparatus thereby to permit advance of such brake member by screw action from a pre-set retracted position towards an operative position, means (26,46,14*a*) forming a mechanical connection between said screw-threaded brake member and said rotatable primary brake component (14) such that rotation of that component (14), no matter what the speed of that rotation, causes screwing of said screw-threaded brake member (24,45,57) towards its said operative position-,and co-operating brake means against which said screw-threaded brake member becomes screwed on reaching its said operative position thereby to impose a frictional braking resistance causing deceleration of the drum to zero, said pre-set retracted position of the said screw-threaded brake member being such that such member does not reach said operative position if the primary brake functions properly.

6. Apparatus according to claim 5, wherein said retracted position of said screw-threaded brake member is pre-settable in said inoperative position such that the distance through which such screw-threaded brake member has to be advanced in order to reach its said operative position is at least twice the distance through which it advances when the apparatus is subjected to a dynamic performance test as prescribed in said British Standard Specification, and the primary brake functions properly in said test.

7. Apparatus according to claim 5 or 6, wherein said drum and said primary braking means and said fail-safe brake are enclosed in a casing, and there is visual indicator means, displayed to the exterior of said casing, which indicator means is coupled to said screw-threaded brake member and is operative to indicate the extent of advancement of said screw-threaded brake member towards its operative position.

8. Apparatus according to claim 6, wherein said screw-threaded brake member and said rotatable brake component (14) are coupled by a spline joint.

9. Apparatus comprising a rotatably mounted drum (2) on which a rope, cable or other coilable tie member (5) can be wound; a primary brake comprising a component (14) which is rotatable against a frictional resistance, a centrifugal clutch (18,19,20) for automatically coupling such component (14) to the drum (2) to cause braking of the drum if it accelerates to a certain speed in the unwinding direction; and a fail-safe brake (24,27,29; 45,27,48; 57,27,48) for arresting the drum (2) in the event of malfunction of said primary brake, said fail-safe brake comprising a screw-threaded member (24,45,57) which is mounted for advancement by screw action from a retracted position towards an operative position, and co-operating fail-safe brake means (27,29) against which said screw-threaded fail-safe member exerts progressive braking pressure by its screw action on reaching that operative position, and means (26,46,14*a*) forming an operative connection between such screw-threaded member (24,45,57) and said rotatable primary brake component (14) such that rotation of that component (14), no matter what the speed of that rotation, causes screwing of said screw-threaded member (24,45,57) towards said operative position, the retracted position of said screw-threaded brake member being pre-set so that said member only reaches its said operative position if the primary brake fails to arrest the drum within a certain angular displacement thereof following application of the primary brake.

10. Apparatus according to claim 1 or claim 9, wherein the said rotatable component (14) of the primary brake is permanently held pressed against at least one fixed co-operating component (13,15,16) of such primary brake.

* * * * *